US011764485B2

(12) United States Patent
Mazur et al.

(10) Patent No.: US 11,764,485 B2
(45) Date of Patent: Sep. 19, 2023

(54) DUAL BAND OMNIDIRECTIONAL ANTENNA

(71) Applicant: UTC Fire & Security EMEA BVBA, Diegem (BE)

(72) Inventors: Mateusz Mazur, Sopot (PL); Marat Patotski, Gdańsk (PL)

(73) Assignee: UTC FIRE & SECURITY EMEA BVBA, Diegem (BE)

( * ) Notice: Subject to any disclaimer, the term of this patent is extended or adjusted under 35 U.S.C. 154(b) by 29 days.

(21) Appl. No.: 17/117,470

(22) Filed: Dec. 10, 2020

(65) Prior Publication Data

US 2022/0052461 A1 Feb. 17, 2022

Related U.S. Application Data

(60) Provisional application No. 63/066,336, filed on Aug. 17, 2020.

(51) Int. Cl.

| | |
|---|---|
| ***H01Q 21/20*** | (2006.01) |
| ***H01Q 5/307*** | (2015.01) |
| ***H01Q 1/48*** | (2006.01) |
| ***H01Q 21/08*** | (2006.01) |

(52) U.S. Cl.
CPC ..... *H01Q 21/20* (2013.01); *H01Q 1/48* (2013.01); *H01Q 5/307* (2015.01); *H01Q 21/08* (2013.01)

(58) Field of Classification Search
CPC ..... H01Q 21/06–08; H01Q 21/20; H01Q 1/24–48; H01Q 5/30–35
See application file for complete search history.

(56) References Cited

U.S. PATENT DOCUMENTS

| | | | |
|---|---|---|---|
| 6,141,335 | A | 10/2000 | Kuwahara et al. |
| 7,064,729 | B2 | 6/2006 | Olson |
| 8,063,832 | B1 | 11/2011 | Weller et al. |
| 8,952,859 | B2 | 2/2015 | Tan |
| 9,997,831 | B2 | 6/2018 | Stratis et al. |
| 10,468,777 | B2 | 11/2019 | Kawahata |
| 10,523,306 | B2 | 12/2019 | Ng et al. |
| 10,541,477 | B2 | 1/2020 | Powell |
| 2002/0113743 | A1 | 8/2002 | Judd et al. |

(Continued)

FOREIGN PATENT DOCUMENTS

DE 102017101676 A1 8/2018

OTHER PUBLICATIONS

Extended European Search Report dated May 17, 2021 for Application No. 20214684.1.

*Primary Examiner* — Hasan Islam
(74) *Attorney, Agent, or Firm* — CANTOR COLBURN LLP

(57) ABSTRACT

Provided are embodiments for a system and a method for operating an omnidirectional antenna. Embodiments include operating a first antenna that includes a first input configured to receive an input signal, a plurality of subarrays configured for transmitting and receiving signals, and a ground plane of the first antenna. Embodiments also include operating a second antenna coupled to the first antenna that includes a second input configured to receive an input signal, a plurality of arms configured for transmitting and receiving signals, a ground plane of the second antenna, and coupling the ground plane of the first antenna and the ground plane of a second antenna.

20 Claims, 5 Drawing Sheets

(56) References Cited

U.S. PATENT DOCUMENTS

| | | | | |
|---|---|---|---|---|
| 2003/0184492 | A1* | 10/2003 | Chiang | H01Q 5/357<br>343/834 |
| 2013/0169505 | A1* | 7/2013 | Shmuel | H01Q 21/00<br>343/848 |

* cited by examiner

600

| NAME | FREQ | RX | Q |
|---|---|---|---|
| M1 | 433.00 | 0.93 +21.39i | 23.03 |
| M2 | 868.00 | 1.12 -5.54i | 4.96 |
| M3 | 2400.00 | 1.14 -1.40i | 1.23 |

DUAL BAND OMNIDIRECTIONAL ANTENNA

CROSS-REFERENCE TO RELATED APPLICATIONS

This application claims the benefit of U.S. Patent Application No. 63/066,336 filed Aug. 17, 2020, which is incorporated herein by reference in its entirety.

BACKGROUND

Exemplary embodiments pertain to the art of wireless communications, and in particular to a system and method for operating a dual band omnidirectional antenna.

Directional antennas radiate energy in a particular general direction, while omnidirectional antennas radiate energy in all directions perpendicular to the azimuthal directions in a plane. These antennas can be used for a variety of applications including global positioning systems (GPS), wireless communications, radio broadcasting, and more. The antenna type can be optimized for various applications. There may be a need to expand the capabilities of an antenna system with respect to the operational characteristic and functionality.

BRIEF DESCRIPTION

According to an embodiment, an antenna system is provided. The system includes a first antenna including a first input configured to receive an input signal; a plurality of subarrays configured for transmitting and receiving signals; and a ground plane of the first antenna. The system also includes a second antenna coupled to the first antenna, where the second antenna includes a second input configured to receive an input signal; a plurality of arms configured for transmitting and receiving signals; and a ground plane of the second antenna, wherein the ground plane of the first antenna is coupled to the ground plane of the second antenna.

In addition to one or more of the features described herein, or as an alternative, further embodiments include a first antenna that is an omnidirectional antenna array, and a second antenna that is a multi-arm folded monopole antenna, wherein at least one of the plurality of arms is connected to a ground plane of the first antenna of at least one of the subarrays.

In addition to one or more of the features described herein, or as an alternative, further embodiments include a plurality of subarrays that include a top layer and a bottom layer, wherein the bottom layer include the ground plane of the first antenna, and the top layer include a plurality of radiating patches.

In addition to one or more of the features described herein, or as an alternative, further embodiments include a common input.

In addition to one or more of the features described herein, or as an alternative, further embodiments include at least one of the plurality of subarrays that includes a low-pass filter that is connected to one of the plurality of radiating patches.

In addition to one or more of the features described herein, or as an alternative, further embodiments include a low-pass filter that is arranged between one of the plurality of arms of the second antenna and one of the plurality of radiating patches.

In addition to one or more of the features described herein, or as an alternative, further embodiments include a radiating patch that is connected to the one of the plurality of arms is located at a top of the subarray.

In addition to one or more of the features described herein, or as an alternative, further embodiments include a first antenna and a second antenna that operate in different frequency bands.

In addition to one or more of the features described herein, or as an alternative, further embodiments include a first antenna that operates in a microwave band and a second antenna that operates in an ultra-high frequency band.

In addition to one or more of the features described herein, or as an alternative, further embodiments include a plurality of subarrays of the first antenna that is arranged in a circular arrangement.

According to another embodiment, a method for operating an antenna system is provided.

The method includes operating a first antenna that includes a first input configured to receive an input signal, a plurality of subarrays configured for transmitting and receiving signals, and a ground plane of the first antenna. The method also includes operating a second antenna coupled to the first antenna that includes a second input configured to receive an input signal, a plurality of arms configured for transmitting and receiving signals, a ground plane of the second antenna, and coupling the ground plane of the first antenna and the ground plane of a second antenna.

In addition to one or more of the features described herein, or as an alternative, further embodiments include a first antenna that is an omnidirectional antenna array, and a second antenna that is a multi-arm folded monopole antenna.

In addition to one or more of the features described herein, or as an alternative, further embodiments include connecting at least one of the plurality of arms to a ground plane of the first antenna of at least one of the subarrays.

In addition to one or more of the features described herein, or as an alternative, further embodiments include a plurality of subarrays that includes a top layer and a bottom layer, wherein the bottom layer includes the ground plane of the first antenna and the top layer includes a plurality of radiating patches.

In addition to one or more of the features described herein, or as an alternative, further embodiments include receiving an input, wherein the first input and the second input are a common input; filtering the received input, wherein the input is filtered using a low-pass filter, wherein the low-pass filter is located at least one of the plurality of microwave subarrays, wherein the low-pass filter is connected to one of the plurality of radiating patches.

In addition to one or more of the features described herein, or as an alternative, further embodiments include a low-pass filter that is arranged between one of the plurality of arms of the second antenna and one of the plurality of radiating patches.

In addition to one or more of the features described herein, or as an alternative, further embodiments include a radiating patch that is connected to the one of the plurality of arms is located at a top of the subarray.

In addition to one or more of the features described herein, or as an alternative, further embodiments include a first antenna and a second antenna that operate in different frequency bands.

In addition to one or more of the features described herein, or as an alternative, further embodiments include operating the first antenna includes operating in a microwave and millimeter (mm) wave bands band and operating the second antenna includes operating in an ultra-high frequency or microwave bands.

In addition to one or more of the features described herein, or as an alternative, further embodiments include arranging the plurality of subarrays of the first antenna in a circular arrangement.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

In today's environment, various antennas are used for a variety of commercial and residential applications. Applications can include radar systems, communication systems (5G), routers for WiFi connection. Antennas can be selected and configured to operate in various frequency bands and power. Antennas used for radar sensor applications and communication, oftentimes occupy a lot of space, especially in cases where they are treated and operated independently.

Antennas can be designed to operate as directional antennas or omnidirectional antennas. Different antenna types may be combined to expand the capabilities of a single antenna or system. However, the proximity of multiple antennas to one another can lead to obstructions or interference, which effectively limits the functional parameters of each antenna or antenna system. In the design process, antenna subsystems (separate antennas) are usually designed independently, and only at the integration stage is the undesirable phenomena of the reduced functionality observed. There may be a need to optimally and efficiently combine multiple antennas into a single antenna system while maintaining the proper functionality of each antenna system.

The techniques of the embodiments described herein combine omnidirectional antennas including a cylindrical antenna array and a multi-arm folded monopole antenna array. The utilization of the integrated antenna system allows for a reduced occupied space in the sensor. The configuration of the embodiments described herein also ensures that mutual obstruction between the antennas is greatly reduced allowing for an undistorted operation.

Figure 1:
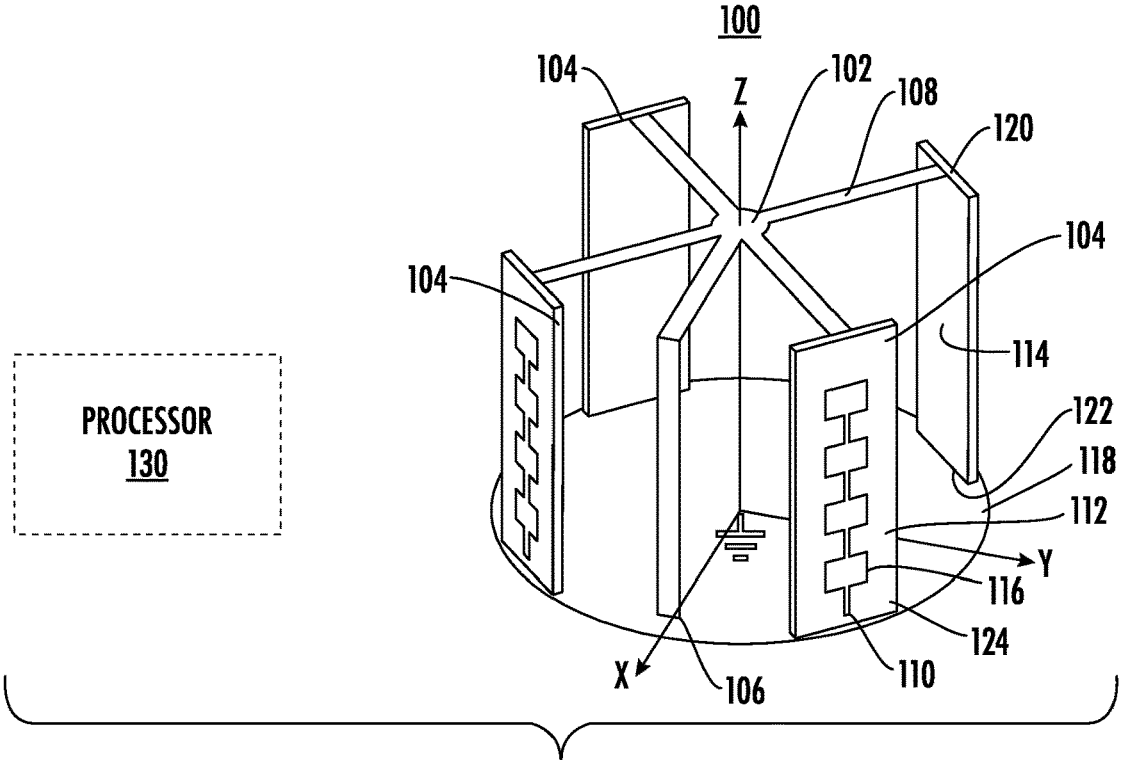
FIG. 1 depicts a system integrating an omnidirectional antenna array and a multi-arm folded monopole in accordance with one or more embodiments.

FIG. 1 depicts a dual antenna system 100 in accordance with one or more embodiments. The antenna system 100 combines a monopole antenna 102 and an omnidirectional antenna array 104 including a plurality of microwave subarrays 124. In a non-limiting example, the monopole antenna 102 is a multi-arm folded monopole antenna having a communication input 106 and fours arms 108. The arms 108 of the monopole are connected to the ground plane of the microwave subarray of the omnidirectional antenna array 104. The monopole antenna 102 can be configured for communication, and the operating range for the monopole antenna 102 can include but is not limited to the ultra-high frequency (UHF) band (e.g., at 433 MHz, 867 MHz, 2.4 GHz, etc.).

The omnidirectional antenna array 104 can include one or more microwave subarrays. In a non-limiting example, the microwave subarrays of the omnidirectional antenna array 104 are positioned in a cylindrical arrangement. Each of the microwave subarrays can be positioned at various degrees apart. In a non-limiting example, the microwave subarrays can be offset by 90° if four subarrays are used. In another example, if six microwave subarrays are used, they may be offset by 60°. Although FIG. 1 shows four microwave subarrays, it should be understood that any number of microwave subarrays can be used in the antenna system 100. Each of the microwave subarrays can include an input 110 that is independent from the communication input 106 of the monopole antenna array 102. In addition, each of the microwave subarrays can include a plurality of radiating microstrip patch elements 116. Although four radiating microstrip patch elements 116 are shown in FIG. 1, it should be understood that any number of radiating microstrip patch elements 116 can be incorporated into each microwave subarray.

As shown in FIG. 1 each of the microwave arrays extends upward from the ground plane 118, and each of the microwave subarrays includes a top layer 112 and a bottom layer 114. The top layer 112 is a substrate where the radiating microstrip patch elements 116 are provided. The bottom layer of the microwave subarray serves as the ground plane 114.

Parts of the microwave array are used as a part of the multi-arm folded monopole 102. In particular, the ground planes 114 of the microwave subarray and the ground plane 118 monopole 102 are connected as illustrated at interface 122. Each of the arms 108 of the monopole 102 is connected to the ground plane 114 of the microwave subarray as shown at the interface 120. This enables the size of the entire antenna system 100 and mutual distortions to be reduced. The multi-arm folded monopole 102 provides reasonable input impedance and better efficiency. The architecture of the system 100 enables additional electronics to be located within the integrated antenna system.

Also shown in FIG. 1, is a processor 130 that is configured to control the antenna system 100. The processor 130 can be operably coupled to the system 100. In some embodiments, the processor 130 is integrated into the system 100. In one or more embodiments, the microwave subarray of the omnidirectional antenna array 104 is configured to operate in the high GHz frequencies (e.g., 10 GHz, 24 GHz, or higher). The processor 130 enables the configuration of the operation of the microwave antenna array by switching on a single microwave subarray or multiple microwave subarrays to operate in an omnidirectional mode or a directional mode. In one or more embodiments, the processor 130 can configure the amplitude and phase distribution within the antenna array to provide the desired radiation characteristic.

Figure 2:
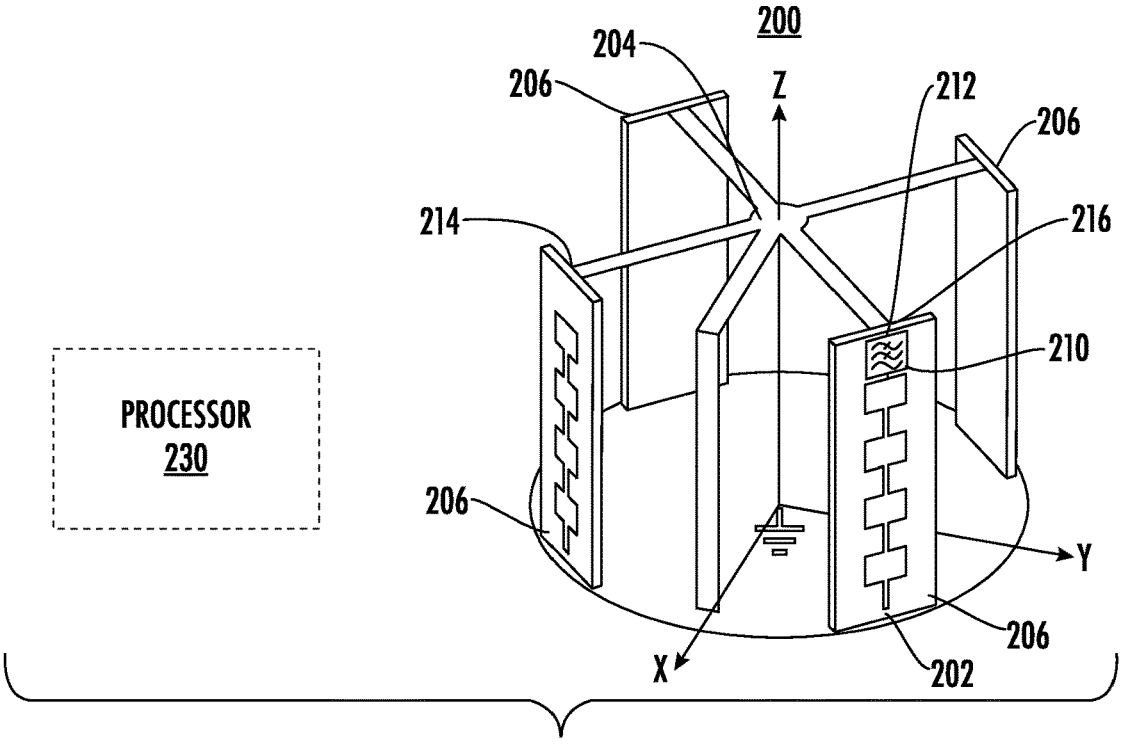
FIG. 2 depicts another system integrating an omnidirectional antenna array and a multi-arm folded monopole having a common input in accordance with one or more embodiments.

FIG. 2 depicts a dual antenna system 200 having a common input 202 for the monopole 204 and omnidirectional antenna array 206. The dual omnidirectional antenna system 200 includes similar components as that shown in FIG. 1 such as the multi-arm folded monopole 204 and the omnidirectional antenna array 206 have a plurality of microwave subarrays 216.

The microwave subarrays 216 may operate using separate transmission and receiving antennas. Alternatively, the microwave subarrays 216 may operate using common transmission and receiving antennas. FIG. 2 depicts a common input 202 for the antenna system 200.

In some embodiments, the processor 230 is integrated into the system 200. In one or more embodiments, a low-pass filter (LPF) 210 allows ultra-high frequency (UHF) signal to pass through and the LPF 210 prevents the flow of microwave current into a monopole while minimizing losses.

In a non-limiting example, the LPF 210 may be required in one of the antenna arrays, and as shown is connected to the last patch of the microwave subarray 216. One of the arms of the monopole 204 is connected to the LFP 210 at the interface 212 while the other arms are connected to the ground plane of the microwave subarray at the interface 214. In a non-limiting example, a single microwave subarray 216 is operational while the other subarrays 216 are used to connect the arms of the multi-arm folded monopole.

Figure 3:
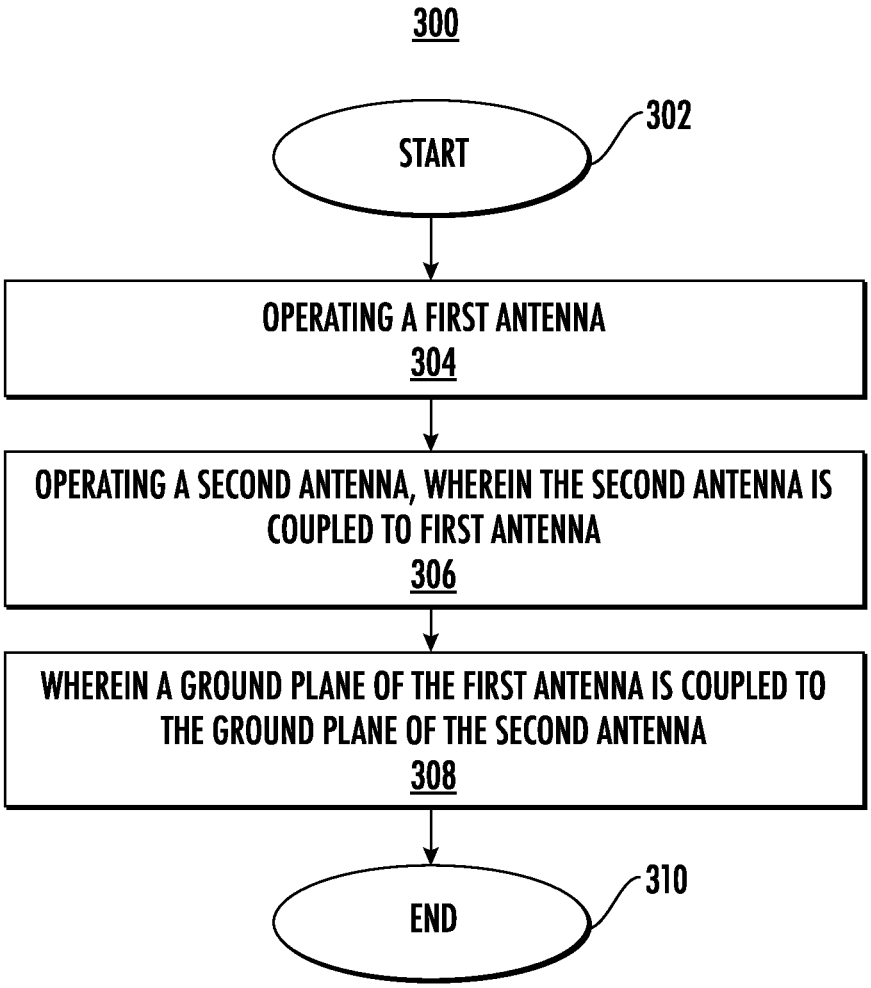
FIG. 3 depicts a flowchart of a method for operating an antenna system in accordance with one or more embodiments.

FIG. 3 depicts a flowchart of a method 300 for operating a dual antenna system in accordance with one or more embodiments. The method 300 can be implemented using the antenna system 100, 200, or other similar types of antenna systems. The method 300 begins at block 302 and proceeds to block 304 which provides for operating a first antenna. In one or more embodiments, the first antenna is an omnidirectional antenna array.

Block 306 operates a second antenna, wherein the second antenna is coupled to the first antenna. The second antenna is a multi-arm folded monopole having a plurality of arms. The multi-arm folded monopole is configured for communication and can be configured with a separate input. In other embodiments, the multi-arm folded monopole can be configured with a common input as the omnidirectional antenna array. In the event the input is shared between the multi-arm folded monopole and the omnidirectional antenna array, an LPF filter can be used to separate the received signals.

Block 308 couples the ground plane of the first antenna to the ground plane of the second antenna. The ground plane is shared between the first and second antennas. This can reduce the size of the antenna system. The method 300 ends at block 310, but it should be understood that additional steps or a different sequence of steps can be performed and is not limited by the steps shown in FIG. 3.

Figure 4A:
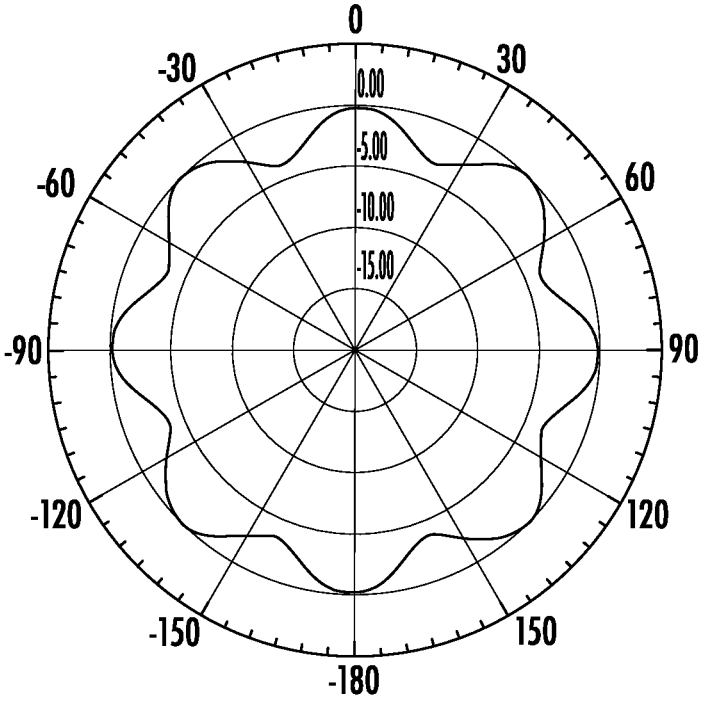
FIGS. 4A and 4B depict antenna characteristics of the subarray of the antenna system in accordance with one or more embodiments.
Figure 4B:
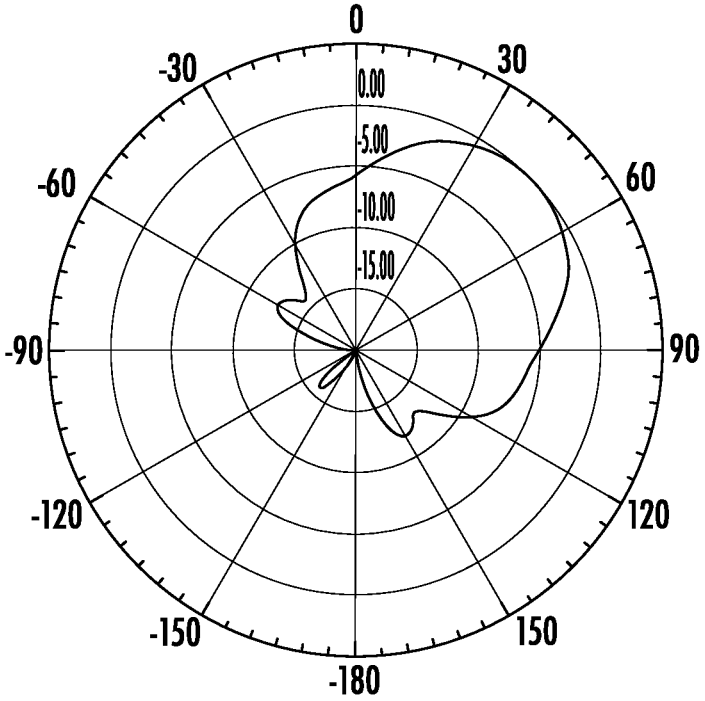

FIGS. 4A and 4B depict antenna characteristics for the dual omnidirectional system. FIG. 4A illustrates the far-field pattern in the Azimuth plane θ=90° when the omnidirectional antenna array is operated in an omnidirectional radiation mode. As shown, there are no nulls or voids in the radiation of the signal, and the pattern shows the energy transmitted efficiently in each direction.

FIG. 4B illustrates the far-field pattern for the antenna system while it is operated in directional mode or a sector scanning radiation mode where a single subarray of the omnidirectional antenna array is used. FIGS. 4A and 4B indicate the omnidirectional antenna array remains viable during the operation of multi-arm folded monopole which is integrated into the antenna system, and the interference is greatly reduced while operating in the omnidirectional mode and the directional mode.

Figure 5A:
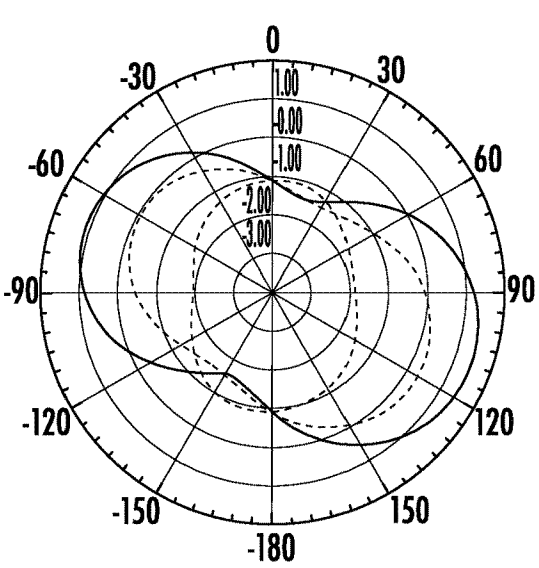
FIGS. 5A, 5B, and 5C depict antenna characteristics of a multi-arm folded monopole of the antenna system in accordance with one or more embodiments.
Figure 5B:
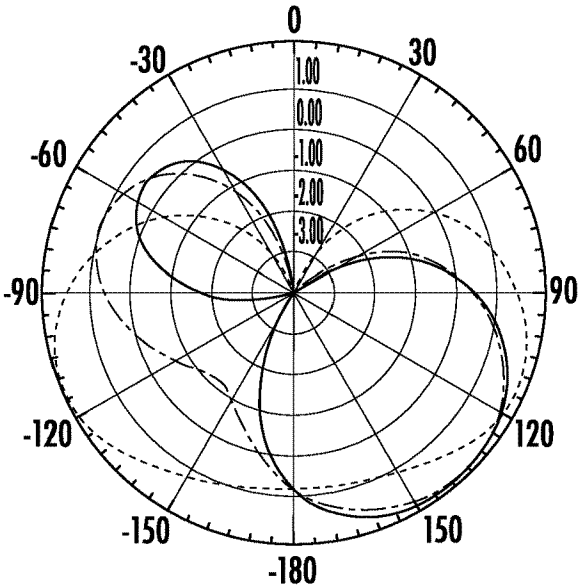
Figure 5C:
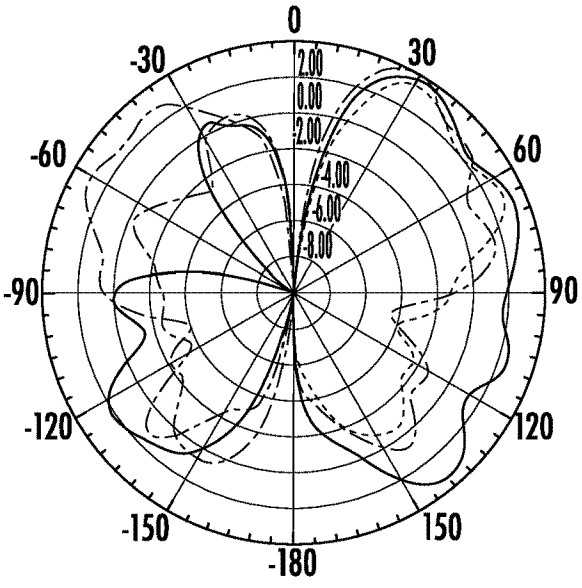

FIGS. 5A, 5B, and 5C depict antenna characteristics for the multi-arm folded monopole in accordance with one or more embodiments. The folded monopole can be the folded monopole implemented in the antenna systems 100, 200. The gain G(θ, φ) of the folded monopole antenna is shown at different frequencies. FIG. 5A illustrates a graph that represents the frequency of 433 MHz. As shown at φ=0°, 45°, and 90° favorable gain characteristics are provided.

FIGS. 5B and 5C illustrate graphs that represent the frequency of 868 MHz and 2.4 GHz, respectively, and also provide favorable gain characteristics. FIGS. 5A-5C illustrate the performance of the operation of the monopole remains viable during the operation of the omnidirectional antenna array and enables the communication using different technologies (LoRa, ZigBee, WiFi) simultaneously.

Figure 6:
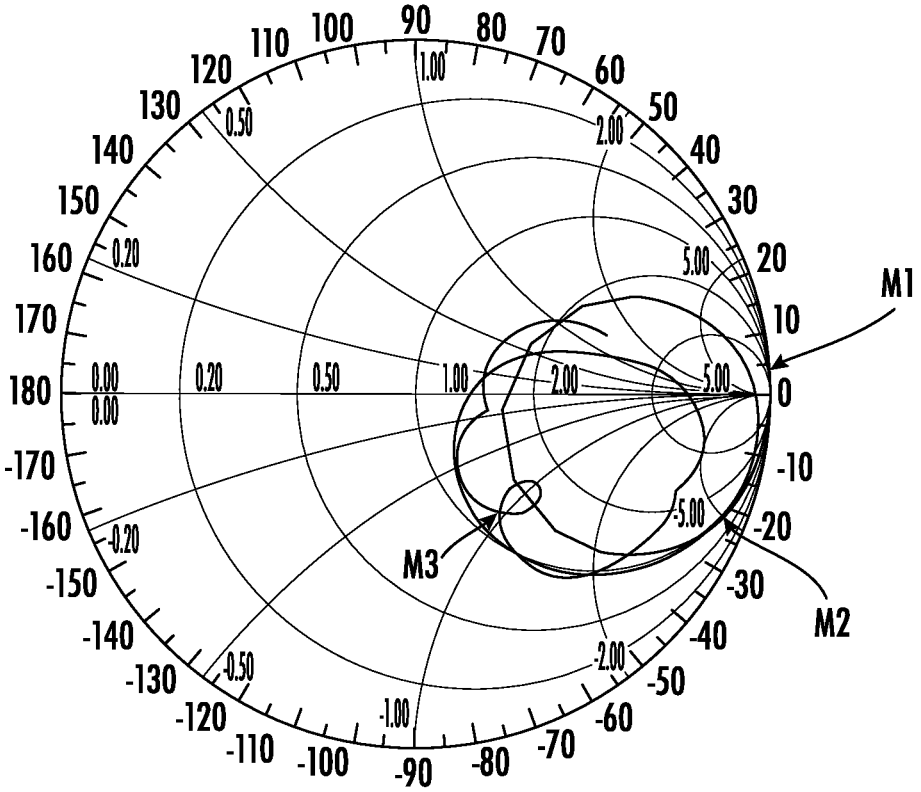
FIG. 6 depicts a graph representing the input impedance of a monopole in accordance with one or more embodiments.

FIG. 6 depicts a chart 600 representing the input impedance of a multi-arm folded monopole for an integrated antenna system such as that shown in FIG. 1. The chart 600 illustrates that a 5-arm monopole that is normalized to 50 ohms. The input impedance (Zin) can be represented by the following Equation 1:

$$Zin=R+iX \quad \text{(Eq. 1)}$$

where R represents the active part and X represents the reactive parts. The scenario including a multi-arm folded monopole with a ground plane higher than λ/4, the active part (R) of the input impedance can be calculated according to the following Equation 2:

$$R=R_0*n^2 \quad \text{(Eq. 2)}$$

where $R_0$ is the radiated resistance of a single wire monopole; n is the number of wires of a multi-arm folded monopole.

Thus, an electrically small multi-arm folded monopole having a large ground plane can provide high efficiencies. However, the resistance of a monopole with a small ground plane drops sharply. The techniques of the embodiments described herein provide that a 5-arm monopole with a short ground plane can provide a high resistance (50 ohms) over a very wide range. The reactive parts of the input impedance (Zin) may be reduced by implementing a matching circuit to enable simultaneous operation at different frequencies.

The frequencies 433 MHz, 868 MHz, and 2.4 GHz are provided by the respective curves m1, m2, m3 on the chart 600. As shown, the active part (R) is 0.93, 1.12, and 1.14 have a quality factor (Q) of 23.03, 4.96, and 1.23, respectively. The increase in the system efficiency and the improved input impedance of a communication antenna, particularly if it is electrically small, can ease the requirements of transmitting and receiving parts.

The technical effects and benefits include combining the folded monopoles and the microwave subarrays into a single omnidirectional antenna system. The footprint of the communication system integrating the multi-arm folded monopole and omnidirectional antenna array is reduced and also provides for reduced mutual distortions. Due to the reduced size of the communication system, the cost of producing the housing for the antenna system can be reduced.

The dual architecture avoids the antennas obstructing the other antenna, therefore improving the performance of the combination of antennas. Provided the simplistic dual architecture, the time of installation is reduced and there is no need to focus on positioning the communication antenna during installation. The dual architecture improves the omnidirectional pattern of the communication antenna in every direction so that no nulls for communication link exist.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A dual-band integrated omnidirectional antenna system comprising:

a first type of antenna; and a second type of antenna integrated with the first type of antenna;

wherein the first type of antenna comprises:

a first input configured to receive a first input signal;

a plurality of subarrays configured for transmitting and receiving a first set of signals; and a first ground plane;

wherein the second type of antenna comprises:

a second input configured to receive a second input signal;

a plurality of arms configured for transmitting and receiving a second set of signals, wherein a portion of each of the plurality of arms comprises one of the plurality of subarrays; and a second ground plane coupled to the first ground plane; and wherein the second type of antenna integrated with the first type of antenna maintains mutual obstruction between the first type of antenna and the second type of antenna below a level that would distort operation of the first type of antenna and the second type of antenna.

2. The system of claim 1, wherein:

the first type of antenna comprises an omnidirectional antenna array;

the second type of antenna comprises a multi-arm folded monopole antenna; and at least one of the plurality of arms is connected to the first ground plane.

3. The system of claim 1, wherein:

each of the plurality of subarrays comprises a top layer and a bottom layer;

the bottom layer comprises the first ground plane; and the top layer comprises a plurality of radiating patches.

4. The system of claim 1, wherein the first input and the second input comprise a common input.

5. The system of claim 3, wherein at least one of the plurality of subarrays comprises a low-pass filter connected to one of the plurality of radiating patches.

6. The system of claim 5, wherein the low-pass filter is arranged between one of the plurality of arms of the second type of antenna and one of the plurality of radiating patches.

7. The system of claim 6, wherein the one of the plurality of radiating patches connected to the one of the plurality of arms is located at a top of the subarray.

8. The system of claim 1, wherein a frequency band of the first type of antenna is different from a frequency band of the second type of antenna.

9. The system of claim 8, wherein the first type of antenna operates in a microwave band and the second type of antenna operates in an ultra-high frequency band.

10. The system of claim 1, wherein the plurality of subarrays of the first type of antenna is arranged in a circular arrangement.

11. A computer-implemented method for operating a dual-band integrated omnidirectional antenna system, the computer-implemented method comprising:

operating, using a processor, a first type of antenna; and operating, using the processor, a second type of antenna integrated with the first type of antenna;

wherein the first type of antenna comprises:

a first input configured to receive a first input signal;

a plurality of subarrays configured for transmitting and receiving a first set of signals; and a first ground plane;

wherein the second type of antenna comprises:

a second input configured to receive a second input signal;

a plurality of arms configured for transmitting and receiving a second set of signals, wherein a portion of each of the plurality of arms comprises one of the plurality of subarrays; and a second ground plane coupled to the first ground plane; and wherein the second type of antenna integrated with the first type of antenna maintains mutual obstruction between the first type of antenna and the second type of antenna below a level that would distort operation of the first type of antenna and the second type of antenna.

12. The computer-implemented method of claim 11, wherein:

the first type of antenna comprises an omnidirectional antenna array; and the second type of antenna comprises a multi-arm folded monopole antenna.

13. The computer-implemented method of claim 11, wherein at least one of the plurality of arms is connected to the first ground plane of at least one of the subarrays.

14. The computer-implemented method of claim 11, wherein:

each of the plurality of subarrays comprises a top layer and a bottom layer;

the bottom layer comprises the first ground plane; and the top layer comprises a plurality of radiating patches.

15. The computer-implemented method of claim 13 further comprising:

receiving a common input comprising the first input and the second input; and filtering, using a low-pass filter, the common input;

wherein the low-pass filter is located on at least one of the plurality of microwave subarrays;

wherein the low-pass filter is connected to one of the plurality of radiating patches.

16. The computer-implemented method of claim 15, wherein the low-pass filter is arranged between one of the plurality of arms of the second type of antenna and one of the plurality of radiating patches.

17. The computer-implemented method of claim 16, wherein the one of the plurality of radiating patches connected to the one of the plurality of arms is located at a top of the subarray.

18. The computer-implemented method of claim 11, wherein a frequency band of the first type of antenna is different from a frequency band of the second type of antenna.

19. The computer-implemented method of claim 11, wherein:

operating the first type of antenna comprises operating in a microwave band; and operating the second type of antenna comprises operating in an ultra-high frequency band.

20. The computer-implemented method of claim 11, wherein the plurality of subarrays of the first type of antenna is arranged in a circular arrangement.

* * * * *